US005902193A

United States Patent [19]

Shimosaka et al.

[11] Patent Number: 5,902,193

[45] Date of Patent: May 11, 1999

[54] GOLF BALL

[75] Inventors: Hirotaka Shimosaka; Keisuke Ihara; Yutaka Masutani; Michio Inoue; Atsuki Kasashima, all of Chichibu, Japan

[73] Assignee: Bridgestone Sports Co., Ltd., Tokyo, Japan

[21] Appl. No.: 08/936,836

[22] Filed: Sep. 25, 1997

[30] Foreign Application Priority Data

Sep. 27, 1996 [JP] Japan ..... 8-277109

[51] Int. Cl.[6] ..... A63B 37/12

[52] U.S. Cl. ..... 473/384; 473/379

[58] Field of Search ..... 473/383, 384

[56] References Cited

U.S. PATENT DOCUMENTS

| | | | |
|---|---|---|---|
| 4,744,564 | 5/1988 | Yamada | 273/232 |
| 5,016,887 | 5/1991 | Jonkouski | 273/232 |
| 5,033,750 | 7/1991 | Yamagishi | 273/232 |
| 5,072,945 | 12/1991 | Oka et al. | 473/384 |
| 5,759,116 | 6/1998 | Kasasima et al. | 473/384 |

FOREIGN PATENT DOCUMENTS

| | | |
|---|---|---|
| 2-134175 | 5/1990 | Japan . |
| 4-231079 | 8/1992 | Japan . |
| 5-300952 | 11/1993 | Japan . |
| 6-7875 | 2/1994 | Japan . |

*Primary Examiner*—George J. Marlo
*Attorney, Agent, or Firm*—Sughrue, Mion, Zinn, Macpeak & Seas, PLLC

[57] ABSTRACT

In a golf ball having a parting line formed at the junction between a pair of mold sections and a plurality of dimples some of which lie across the parting line, the average space volume Vp of the dimples lying across the parting line is greater than the average space volume Vp' of the remaining dimples lying outside the parting line and/or the average Dp/Dm of the dimples lying across the parting line is greater than the average Dp/Dm of the remaining dimples lying outside the parting line wherein Dp and Dm are the depth and diameter of dimples, respectively. The golf ball is improved in symmetry in that no substantial difference occurs in flight distance between seam hitting and pole hitting.

4 Claims, 4 Drawing Sheets

GOLF BALL

BACKGROUND OF THE INVENTION

1. Field of the Invention

This invention relates to a dimpled golf ball free of a great circle which does not intersect with the dimples and having high symmetry.

2. Prior Art

The flying performance of golf balls is greatly affected by the arrangement and configuration (including diameter, depth and cross-sectional shape) of dimples. Various dimple arrangements are known in the art for arranging a plurality of dimples on the ball surface in an even or dense fashion. Typical known dimple arrangements are regular polyhedral arrangements. It is also known to equally divide the hemisphere into one to seven sections, especially three to six sections from its center.

It is attempted in JP-B 7875/1994 to tailor the dimple configuration such that the overall effective volume of dimples remains substantially equal between pole hitting (the spin axis is in the equator plane) and seam hitting (the spin axis is a pole-to-pole line).

Golf balls are generally molded in an axisymmetric manner by using a mold comprising a pair of mold halves, removably mating them along a parting line to define a spherical cavity therein, and introducing stock material into the cavity. The thus molded golf balls tend to have a higher degree of roundness or sphericity about a pole-to-pole axis corresponding to a line connecting the apexes of the mold half cavities, but a lower degree of roundness about an axis on a plane circumscribed by a seam line corresponding to the parting plane of the mold. Because of such roundness variation, conventional golf balls exhibit different flight performance depending on the position at which the ball is hit. Such flight performance variation raises a serious problem in the game of golf wherein the Rules of Golf prescribe that "the ball shall be played as it lies, except as otherwise provided in the Rules."

More specifically, when a golf ball is hit by a club, the ball is given back spin although the number of revolutions varies with a particular type of club. The ball hitting is generally classified into pole hitting and seam hitting depending on an impact point. Reference is now made to FIG. 4(A) and 4(B) wherein a golf ball 11 has a seam line 12 and a center 16. The pole hitting means that the ball 11 is hit at arrow 20 so as to give back spin about a straight line 18 connecting two diametrically opposed points 14, 14 on the seam line 12 and the center 16 as shown in FIG. 4(A). The seam hitting means that the ball 11 is hit at arrow 26 so as to give back spin about a straight line 24 extending perpendicular to a circular plane 22 circumscribed by the seam line 12 and passing the center 16. As previously mentioned, in the event of pole hitting shown in FIG. 4(A), the ball is susceptible to extra lift or drag since it does not define a true circle about the spin axis 18. On the other hand, in the event of seam hitting shown in FIG. 4(B), the ball is substantially free of extra lift or drag since it is close to a true circle about the spin axis 24. As a consequence, if the ball is simply designed such that the effect of dimples may be equal between pole hitting and seam hitting, the effect of dimples would be greater on pole hitting because of a deviation from roundness. Then on pole hitting, the golf ball receives extra lift or drag, exhibiting different flight performance than on seam hitting. This means that the flight performance varies with a particular hit position.

To produce a golf ball which is improved in symmetry in that the flight performance remains constant regardless of a particular hit position, the arrangement and configuration of dimples must be designed in consideration of the shape or roundness of the ball so as to optimize the effect of dimples. This requirement has not been fully satisfied.

SUMMARY OF THE INVENTION

Therefore, an object of the present invention is to provide a golf ball which is improved in symmetry in that the ball will follow the same trajectory on either seam hitting or pole hitting, that is, the flight performance does not vary with a particular hit position.

The present invention is directed to a golf ball prepared by molding in a mold comprising a pair of mold sections which are removably mated to define a spherical cavity therein. The golf ball has a parting line formed at the junction between the mold sections and a plurality of dimples some of which lie across the parting line. The golf ball is free of a great circle which does not intersect with the dimples.

According to a first aspect of the invention, the dimples lying across the parting line have an average space volume Vp which is greater than the average space volume Vp' of the remaining dimples lying outside the parting line.

According to a second aspect of the invention, provided that the dimples have a diameter Dm and a depth of Dp, the dimples lying across the parting line have an average Dp/Dm which is greater than the average Dp/Dm of the remaining dimples lying outside the parting line.

Golf balls having dimples with a fixed value of Dp/Dm are known from JP-A 134175/1990 and 231079/1992, for example. Golf balls having some dimples disposed across the parting line are also known from JP-A 300952/1993, for example.

Although the arrangement of dimples on the parting line is effective for improving symmetry, the number of dimples lying across the parting line is limited and there is still left a room for improvement in symmetry. Even when dimples are distributed in a regular icosahedral arrangement, the symmetry is still not fully satisfactory in the sense that pole hitting and seam hitting give different flight distances.

We have found that when the average space volume Vp of the dimples lying across the parting line is greater than the average space volume Vp' of the remaining dimples lying outside the parting line and/or when the average Dp/Dm of the dimples lying across the parting line is greater than the average Dp/Dm of the remaining dimples lying outside the parting line, the ball is improved in symmetry to such an extent that no substantial difference occurs in flight difference between pole hitting and seam hitting. The improved symmetry is accomplished even when the number of dimples lying across the parting line is small and regardless of dimple arrangements.

BRIEF DESCRIPTION OF THE DRAWINGS

These and further features of the present invention will be apparent with reference to the following description and drawings, wherein.

DETAILED DESCRIPTION OF THE INVENTION

The golf ball of the invention has a plurality of dimples indented in its spherical surface. The golf ball is free of a great circle which does not intersect with the dimples. The golf ball is prepared by molding a stock material in a mold comprising a pair of mold sections which are removably mated to define a spherical cavity therein. A parting line is thus formed on the golf ball at the junction between the mold sections. Some of the dimples lie across the parting line. There is not a great circle line which does not intersect with the dimples. It is understood that the line which does not intersect with a dimple is a line which does not traverse a dimple. In this sense, the dimple which is tangent to the great circle is considered as a dimple which does not intersect with the great circle.

Well-known methods may be used to form dimples on the parting line. It is convenient to use a mold wherein dimple-forming pins are disposed in one or both of the parting surfaces of upper and lower mold sections.

According to the first aspect of the invention, provided that the dimples lying across the parting line have an average space volume Vp and the remaining dimples lying outside the parting line have an average space volume Vp', Vp is greater than Vp'. Then there is obtained a golf ball which exhibits no substantial difference in flight distance between seam hitting and pole hitting. Preferably the difference between Vp and Vp' is 0.02 to 0.3 $mm^3$, especially 0.05 to 0.2 $mm^3$. The ball symmetry would sometimes lower if the difference between Vp and Vp' is less than 0.02 $mm^3$ or more than 0.3 $mm^3$. An average value of Vp is generally 0.6 to 1.4 $mm^3$, especially 0.8 to 1.2 $mm^3$. An average value of Vp' is generally 0.65 to 1.45 $mm^3$, especially 0.85 to 1.25 $mm^3$.

Figure 1A:
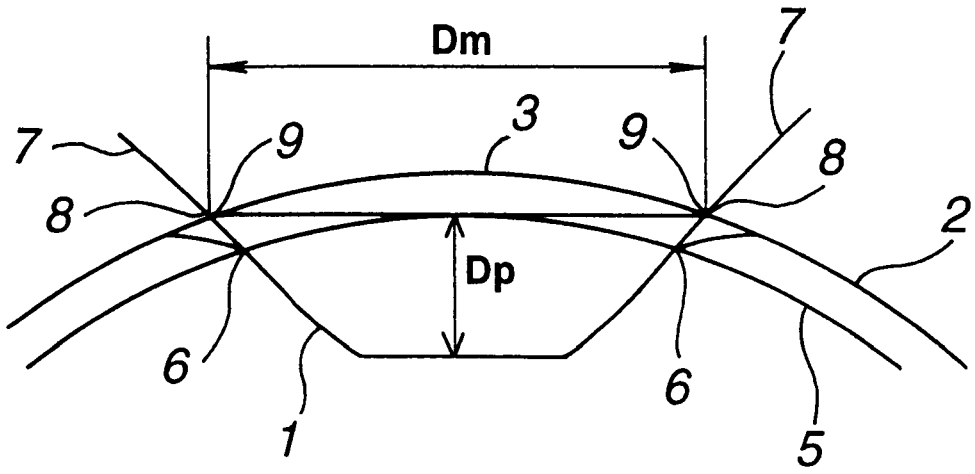
FIG. 1(*a*) illustrates the diameter Dm and depth Dp of a dimple and FIG. 1(*b*) illustrates the space volume Vp or Vp' of a dimple.
Figure 1B:
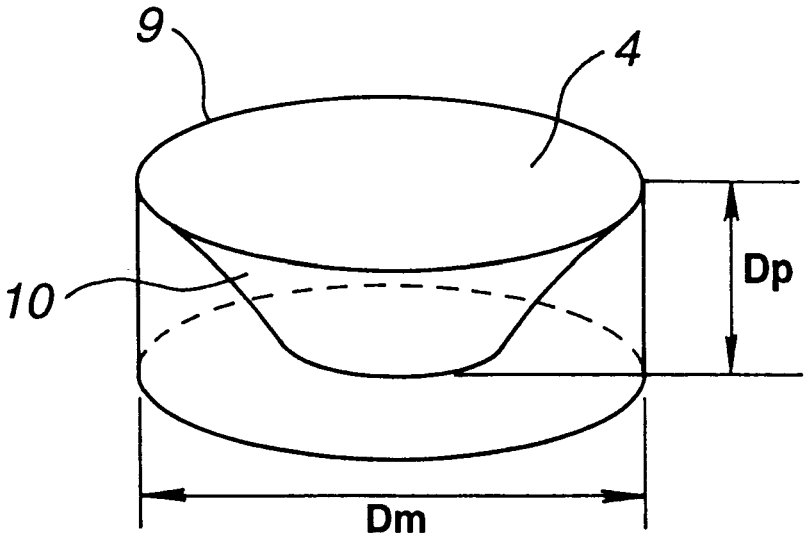

Referring to FIG. 1, it is described how to calculate the space volume of an individual dimple from which Vp or Vp' is determined. It is provided that the dimple has a circular plane shape. In conjunction with the dimple 1 and the surrounding land 2, as shown in FIG. 1(*a*), there are drawn a phantom spherical surface 3 having a ball diameter and another phantom spherical surface 5 having a diameter smaller by 0.06 mm than the ball diameter. The other spherical surface 5 intersects with the dimple 1 at a point 6. A tangent 7 at intersection 6 intersects with the phantom spherical surface 3 at a point 8. A series of intersections 8 define a dimple edge 9. The dimple edge 9 is so defined for the reason that otherwise, the exact position of the dimple edge cannot be determined because the actual edge of the dimple 1 is rounded.

For the dimple design, it is a common practice to assume a phantom spherical surface. For example, a phantom spherical surface having a radius which is smaller by 0.003 inch (0.08 mm) than the radius of the ball is assumed in JP-A 8630/1975. Such settings sometimes fail to accommodate the diversification of dimples as by reducing the depth Dp of dimples for the purposes of reducing the spin susceptibility of the ball and increasing the percent surface occupation by dimples or configuring the dimple edge to a shape other than a circle. The present invention accommodates the diversification of dimples by setting the unique requirement.

The diameter Dm of a dimple as used herein is the diameter of a plane (circular plane 4 in FIGS. 1(*a*) and l(*b*)) circumscribed by the dimple edge 9. The depth Dp is the distance from the center of the diameter Dm to the bottom of the dimple. Then as shown in FIG. 1(*b*), the dimple 1 defines a space 10 located from the circular plane 4 circumscribed by the dimple edge 9 and having the diameter Dm to the depth Dp. The volume Vp or Vp' of the dimple space 10 is determined in this way.

In the event that the planar shape of a dimple is not circular, the maximum diameter or length of a dimple is determined, the plane projected shape of the dimple is assumed to be a circle having a diameter equal to this maximum diameter or length, and the maximum depth Dm is assumed to be a distance from the point of the dimple having the maximum depth to the plane. The dimple space volume Vp or Vp' is similarly calculated using these parameters.

According to the second aspect of the invention, the ratio of diameter Dm to depth Dp of a dimple, aspect ratio, is specified. Specifically, the average value of Dp/Dm of the dimples lying across the parting line is greater than the average value of Dp/Dm of the remaining dimples lying outside the parting line. This relationship is advantageously applied to the golf ball of the first aspect, that is, the golf ball wherein the average space volume Vp of the dimples lying across the parting line is greater than the average space volume Vp' of the remaining dimples lying outside the parting line. This relationship is also advantageously applied to the golf ball wherein those dimples lying across the parting line are formed to a smaller diameter than the remaining dimples lying outside the parting line for the convenience of arrangement and therefore, the average Vp cannot be greater than the average Vp'. Even when the average Vp is equal to or less than the average Vp' or when the difference between the average Vp and the average Vp' is less than 0.02 $mm^3$, a golf ball having improved symmetry is obtained by setting the average value of Dp/Dm of the dimples lying across the parting line to be greater than the average value of Dp/Dm of the remaining dimples lying outside the parting line.

The difference between the average value of Dp/Dm of the dimples lying across the parting line and the average value of Dp/Dm of the remaining dimples lying outside the parting line is preferably 0.01 to 0.1, especially 0.04 to 0.08. The ball symmetry would be somewhat lost when this difference is less than 0.01 or more than 0.1.

It is recommended that the average value of Dp/Dm of the dimples lying across the parting line is at least 0.045, preferably 0.045 to 0.6, more preferably 0.045 to 0.055. With an average Dp/Dm of less than 0.045, the ball would be somewhat low in symmetry or follow a higher trajectory.

The average value of Dp/Dm of the remaining dimples lying outside the parting line is not particularly limited insofar as it is smaller than the average Dp/Dm of the dimples lying across the parting line. It is recommended that the average value of Dp/Dm of the dimples lying outside the parting line is at most 0.045, more preferably 0.038 to 0.045, more preferably 0.04 to 0.045. With an average Dp/Dm of more than 0.045, the ball would be somewhat low in symmetry or follow a higher trajectory.

The planar shape of dimples is not critical although it is typically circular. Preferably dimples have a diameter of 2.0 to 4.6 mm, especially 3.2 to 4.0 mm and a depth of 0.1 to 0.25 mm, especially 0.13 to 0.2 mm.

In the golf ball of the invention, the overall number of dimples is generally 240 to 600, preferably 340 to 450. The number of dimples lying across the parting line is usually 3 to 40, preferably 8 to 18. If the number of dimples lying across the parting line is less than 3, the symmetry improvement by specifying the space volume or aspect ratio of dimples would be insufficient. If the number of dimples lying across the parting line is more than 40, the mold sections would become weak near the parting surface. The dimples may be of one type having an identical diameter and depth or of two or more types which are a different in diameter and/or depth. It is preferred to distribute dimples of two to five types, especially two to four types having different diameters.

The pattern of dimple arrangement may be selected from various patterns, for example, regular octahedral, dodecahedral and icosahedral arrangements.

Insofar as the dimple design satisfies the above-mentioned requirement(s), the golf ball of the invention may have any desired structure. The invention is applicable to solid golf balls including one-piece golf balls, two-piece golf balls, and multi-piece golf balls of three or more layer structure as well as wound golf balls. These golf balls can be prepared from well-known stock materials by conventional methods.

The diameter and weight of the golf ball may be properly determined in accordance with the Rules of Golf.

EXAMPLE

Examples of the invention are given below by way of illustration and not by way of limitation.

Examples 1–4 and Comparative Examples 1–3

Figure 2:
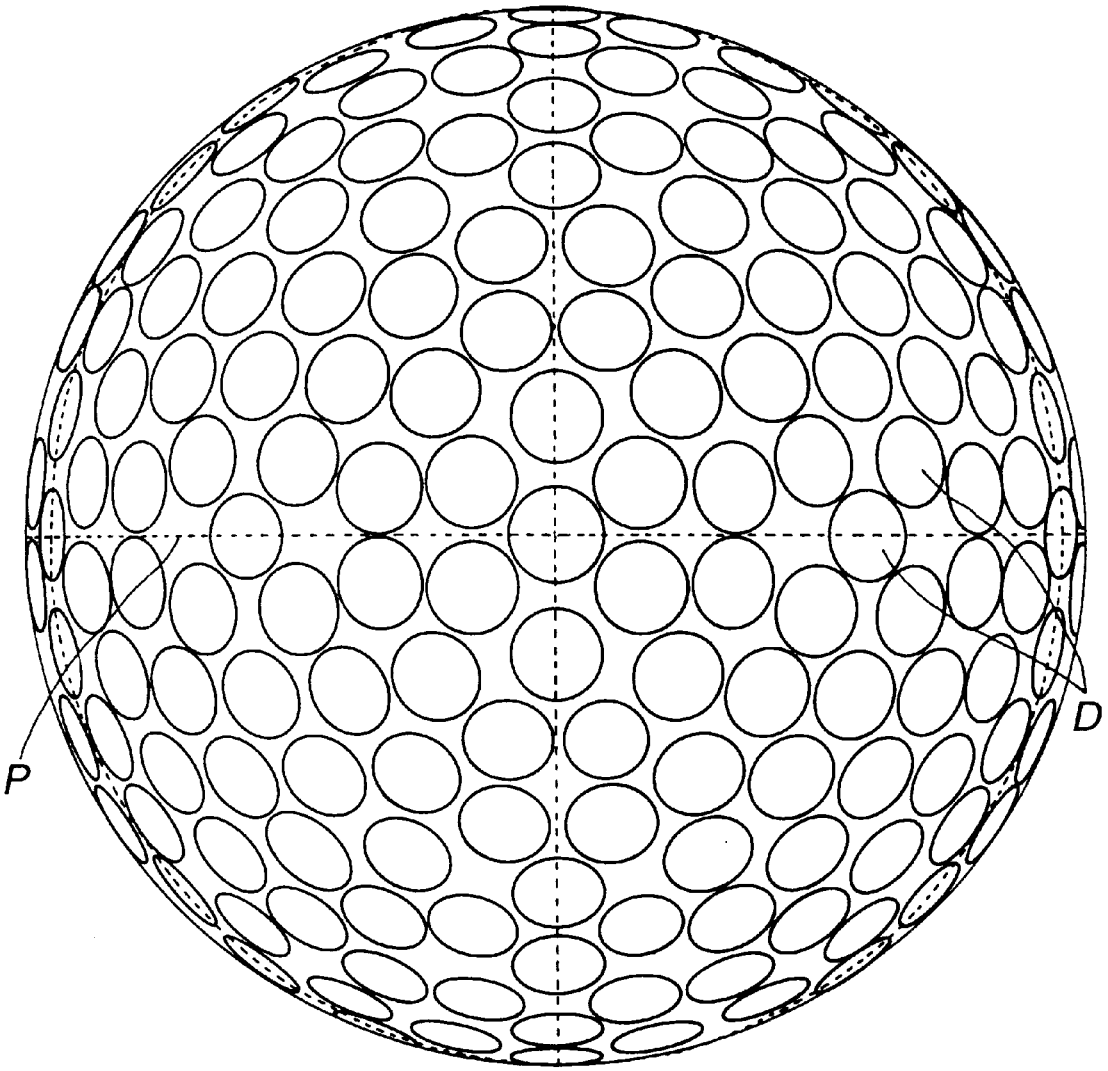
FIG. 2 schematically illustrates the pattern of dimple arrangement on golf balls of Examples 1–2 and Comparative Examples 1–2.
Figure 3:
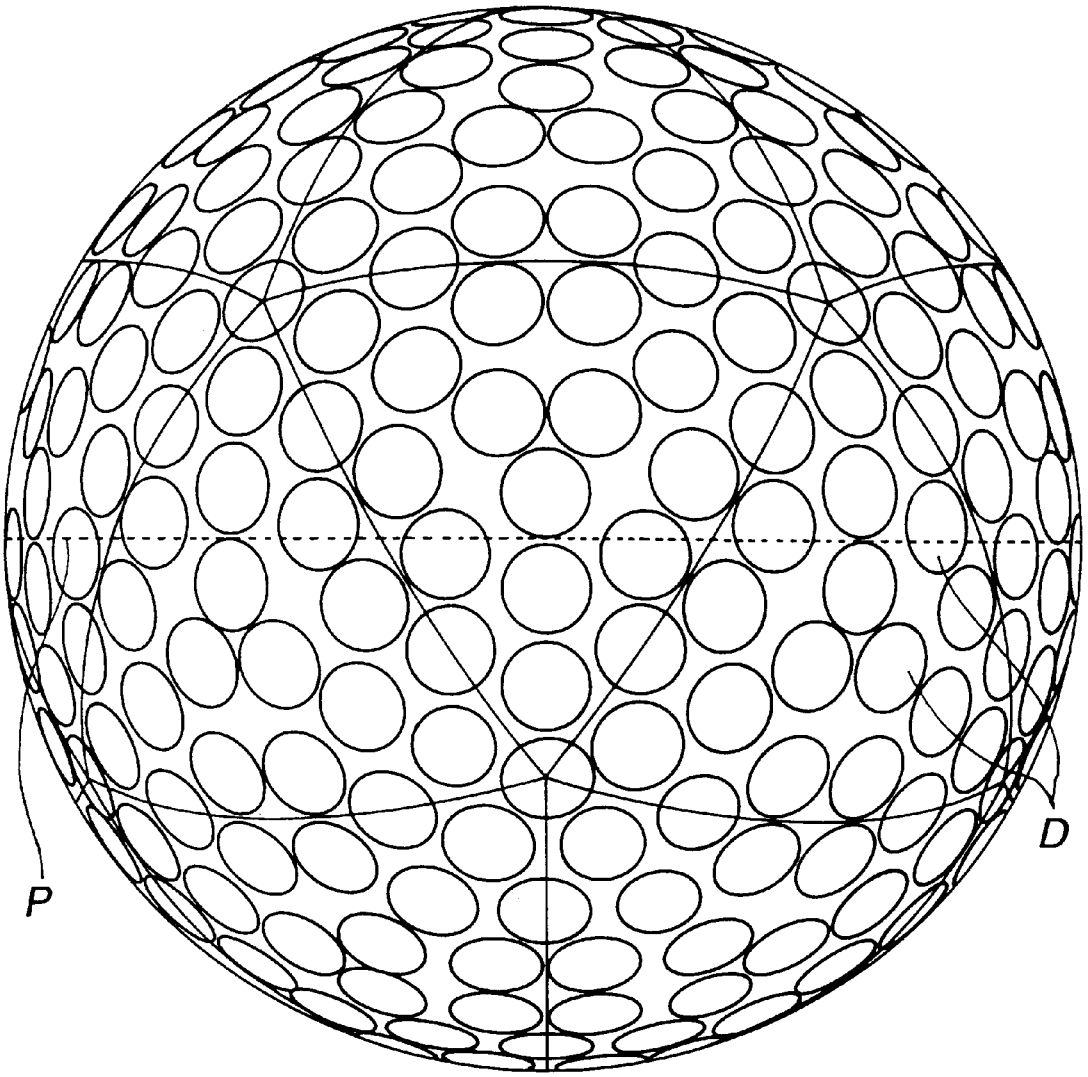
FIG. 3 schematically illustrates the pattern of dimple arrangement on golf balls of Examples 3–4 and Comparative Example 3.

On two-piece solid golf balls of the large size (diameter 42.7 mm and weight 45.4 grams) having an ionomer resin cover, dimples having parameters shown in Tables 1 to 3 were arranged in the pattern shown in FIGS. 2 and 3. In FIGS. 2 and 3, P is a parting line and D designates dimples.

The core and the cover were prepared from well-known stocks.

TABLE 1

| | | Diameter Dm (mm) | Depth Dp (mm) | Space volume ($mm^3$) | Dp/Dm | Overall number |
|---|---|---|---|---|---|---|
| Example 1 | on PL | 3.600 | 0.190 | 1.01 | 0.053 | 5 |
| | | 3.800 | 0.190 | 1.12 | 0.050 | 5 |
| | outside PL | 3.600 | 0.164 | 0.87 | 0.046 | 182 |
| | | 3.800 | 0.164 | 0.97 | 0.043 | 170 |
| Example 2 | on PL | 3.600 | 0.190 | 1.01 | 0.053 | 5 |
| | | 3.800 | 0.190 | 1.12 | 0.050 | 5 |
| | outside PL | 3.600 | 0.166 | 0.88 | 0.046 | 182 |
| | | 3.800 | 0.166 | 0.98 | 0.044 | 170 |
| Example 3 | on PL | 3.730 | 0.172 | 0.98 | 0.046 | 20 |
| | outside P | 3.640 | 0.164 | 0.89 | 0.045 | 352 |
| Example 4 | on PL | 3.560 | 0.172 | 0.89 | 0.048 | 20 |
| | outside PL | 3.720 | 0.158 | 0.89 | 0.042 | 352 |

TABLE 2

| | | Diameter Dm (mm) | Depth Dp (mm) | Space volume ($mm^3$) | Dp/Dm | Overall number |
|---|---|---|---|---|---|---|
| Comparative Example 1 | on PL | 3.600 | 0.166 | 0.88 | 0.046 | 5 |
| | | 3.800 | 0.166 | 0.98 | 0.044 | 5 |
| | outside PL | 3.600 | 0.166 | 0.88 | 0.046 | 182 |
| | | 3.800 | 0.166 | 0.98 | 0.044 | 170 |
| Comparative Example 2 | on PL | 3.600 | 0.142 | 0.75 | 0.039 | 5 |
| | | 3.800 | 0.142 | 0.84 | 0.037 | 5 |
| | outside PL | 3.600 | 0.168 | 0.89 | 0.047 | 182 |
| | | 3.800 | 0.168 | 0.99 | 0.044 | 170 |
| Comparative Example 3 | on PL | 3.620 | 0.164 | 0.89 | 0.045 | 20 |
| | outside PL | 3.620 | 0.164 | 0.89 | 0.045 | 352 |

TABLE 3

| | | | E1 | E2 | E3 | E4 | CE1 | CE2 | CE3 |
|---|---|---|---|---|---|---|---|---|---|
| Average values of dimples | on PL | Space volume ($mm^3$) | 1.06 | 1.06 | 0.98 | 0.89 | 0.93 | 0.79 | 0.89 |
| | | Dp/Dm | 0.051 | 0.051 | 0.046 | 0.048 | 0.045 | 0.038 | 0.045 |
| | outside PL | Space volume ($mm^3$) | 0.92 | 0.93 | 0.89 | 0.89 | 0.93 | 0.94 | 0.89 |
| | | Dp/Dm | 0.044 | 0.045 | 0.045 | 0.042 | 0.045 | 0.045 | 0.045 |
| Total dimple number | | | 362 | 362 | 372 | 372 | 362 | 362 | 372 |
| Total dimple space volume ($mm^3$) | | | 333 | 337 | 332 | 332 | 336 | 336 | 332 |
| Dimple arrangement pattern | | | FIG. 2 | FIG. 2 | FIG. 3 | FIG. 3 | FIG. 2 | FIG. 2 | FIG. 3 |

Figure 4A:
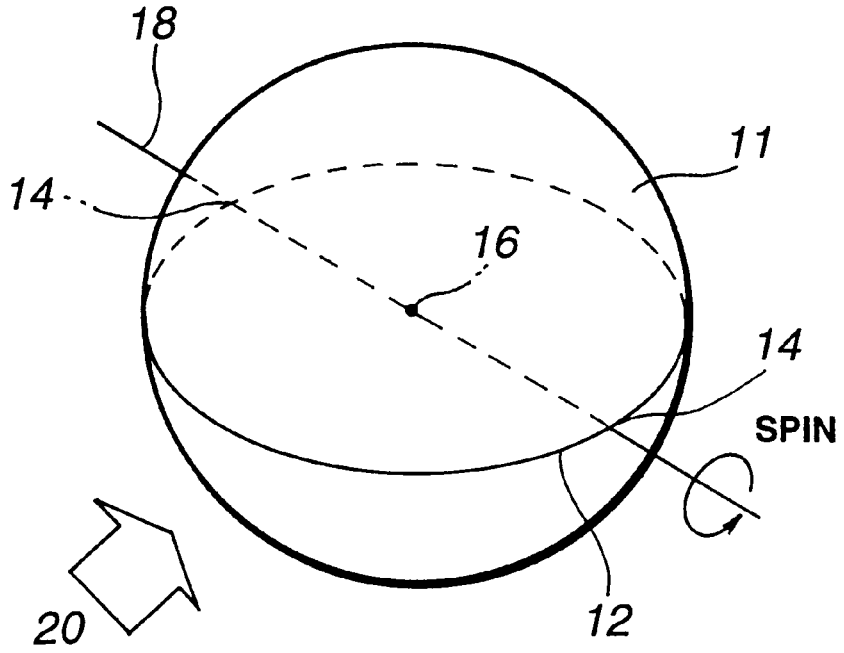
FIG. 4 illustrates the direction in which a golf ball is hit by a club, FIG. 4(A) corresponding to pole hitting and FIG. 4(B) corresponding to seam hitting.
Figure 4B:
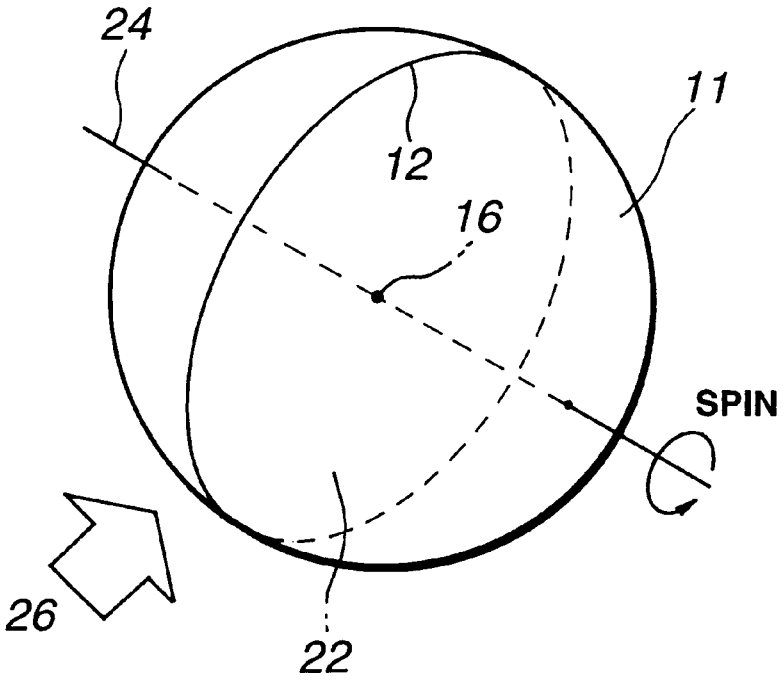

The golf balls were tested by means of a swing robot using a driver (#W1) as a club. The balls were repeatedly hit at a head speed of 45 m/sec. by pole hitting (in the hitting direction shown in FIG. 4(A)) and seam hitting (in the hitting direction shown in FIG. 4(B)). The carry (expressed in meter) and trajectory were examined. The results are shown in Table 4.

TABLE 4

| | Carry (m) | | |
|---|---|---|---|
| HS = 45 m/s | Pole hitting | Seam hitting | Trajectory |
| E1 | 228 | 227 | satisfactory |
| E2 | 226 | 226 | somewhat low overall |
| E3 | 228 | 229 | satisfactory |
| E4 | 227 | 228 | satisfactory |
| CE1 | 223 | 228 | high on pole hitting |
| CE2 | 216 | 224 | very high on pole hitting |
| CE3 | 225 | 228 | high on pole hitting |

There has been described a golf ball which is improved in symmetry in that the ball will travel a substantially equal distance on either seam hitting or pole hitting.

Japanese Patent Application No. 277109/1996 is incorporated herein by reference.

Although some preferred embodiments have been described, many modifications and variations may be made thereto in the light of the above teachings. It is therefore to be understood that within the scope of the appended claims, the invention may be practiced otherwise than as specifically described.

What is claimed is:

1. In a golf ball prepared by molding in a mold comprising a pair of mold sections which are removably mated to define a spherical cavity therein, the golf ball having a parting line formed at the junction between the mold sections and a plurality of dimples some of which lie across the parting line and being free of a great circle which does not intersect with the dimples, the improvement wherein the dimples lying across the parting line have an average space volume Vp which is greater than the average space volume Vp' of the remaining dimples lying outside the parting line.

2. In a golf ball prepared by molding in a mold comprising a pair of mold sections which are removably mated to define a spherical cavity therein, the golf ball having a parting line formed at the junction between the mold sections and a plurality of dimples some of which lie across the parting line and being free of a great circle which does not intersect with the dimples, the improvement wherein provided that the dimples have a diameter Dm and a depth of Dp, the dimples lying across the parting line have an average Dp/Dm which is greater than the average Dp/Dm of the remaining dimples lying outside the parting line.

3. The golf ball of claim 2 wherein the dimples lying across the parting line have an average Dp/Dm of at least 0.045.

4. The golf ball of claim 2 wherein the remaining dimples lying outside the parting line have an average Dp/Dm of up to 0.045.

* * * * *